US005960503A

United States Patent [19]

Del Pozo Y Mattei

[11] Patent Number: 5,960,503

[45] Date of Patent: Oct. 5, 1999

[54] KITCHEN UTENSIL CLEANING TOOL

[76] Inventor: Gilberto R. Del Pozo Y Mattei, Av. Central No. 215 Fracc, Calpulli, 20296 Aguascalientes, AGS, Mexico

[21] Appl. No.: 08/982,967

[22] Filed: Dec. 2, 1997

[51] Int. Cl.[6] ..... A46B 13/04

[52] U.S. Cl. ..... 15/29; 15/4; 15/24; 15/97.1

[58] Field of Search ..... 15/24, 29, 4, 97.1

[56] References Cited

U.S. PATENT DOCUMENTS

| | | | |
|---|---|---|---|
| 1,480,461 | 1/1924 | Nutter | 15/97.1 X |
| 1,604,500 | 10/1926 | Tannenbaum | 15/29 |
| 1,625,792 | 4/1927 | Carrington | 15/29 |
| 3,307,211 | 3/1967 | Gaines | 15/4 |
| 3,409,924 | 11/1968 | Slama | 15/24 |
| 3,638,264 | 2/1972 | Walton | 15/29 X |
| 4,254,526 | 3/1981 | Fromm | 15/29 |
| 4,335,481 | 6/1982 | Slayman | 15/29 |
| 5,649,334 | 7/1997 | Henriquez et al. | 15/29 |
| 5,701,625 | 12/1997 | Siman | 15/29 X |

FOREIGN PATENT DOCUMENTS

| | | | |
|---|---|---|---|
| 584273 | 1/1947 | United Kingdom | 15/29 |
| 2180444 | 4/1987 | United Kingdom | 15/29 |

*Primary Examiner*—Mark Spisich
*Attorney, Agent, or Firm*—Ladas & Parry

[57] ABSTRACT

The present invention refers to an electric, hydraulic, kitchen utensil cleaning tool, being adapted for use with one hand to wash all types of kitchenware in homes, hotels, restaurants, hospitals, etc. It is operated with water from the kitchen pipe line via a hose. It has three systems: Water, Detergent, and Power Systems. To integrate these systems together it has a main connecting receiving element (MCRE) which has: valves and ducts for water and detergent, a sleeve plug and a seal to couple the hollow shaft of a drive motor to the MCRE. The MCRE is connected to a detergent reservoir having an integrated injector. The detergent is mixed with water in a T connection formed by the water and detergent ducts. The mixture passes through the hollow shaft. Cleaning is performed by a rotating cleaning head at the end of the hollow shaft. The cleaning head has a brush and an annular fiber scrub pad.

13 Claims, 6 Drawing Sheets

KITCHEN UTENSIL CLEANING TOOL

BACKGROUND OF THE INVENTION

At present, the cleaning of kitchenware, both industrially, as well as in the home, is carried out by one of two general alternatives:

1. Cleaning by hand, or
2. Automatic dishwashers.

However, each one has their own drawbacks, for example, cleaning by hand in restaurants, bars, cafeterias, ice-cream parlours or similar, hospitals, etc., require large quantities of water, detergent, time and at least, a person exclusively dedicated to this task, requires such special facilities as sinks or drains, one dedicated to eliminate organic residuals, another to lather and to rinse the detergent and one last to disinfect. At home this is limited to one or two sinks, because the volume of kitchen utensils to wash is quite small compared to that of public places, as those before mentioned. Occasionally contact exists among the person's hands that is washing the utensils, due to avoiding using gloves or because of the glove breaking by friction or puncture, which can cause transport of microbes from the hands to the utensils.

The second alternative—automatic dishwashers—are limited to a certain volume of kitchen utensils and it can not accelerate the cleaning cycle unless provided with several dishwasher machines that generally are expensive, require more physical space and special facilities.

SUMMARY OF THE INVENTION

An objective of the present invention is to offer a third alternative combining the two alternatives before mentioned with the advantages that are listed as follows:

The Invention vs. Wash by Hand

1. More efficiency.
2. More comfort.
3. Water savings.
4. Better use of current hydraulic and sanitary facilities.
5. By this alternative washing gloves life is extended, reducing contamination risks of hand washing, hence allowing further hygiene.

The Invention vs. Automatic Dishwashers

1. Lower investment.
2. Lower operation costs.
3. Less space usage for operation and storage.
4. Water savings.

DETAILED DESCRIPTION OF THE INVENTION

Figure 1:
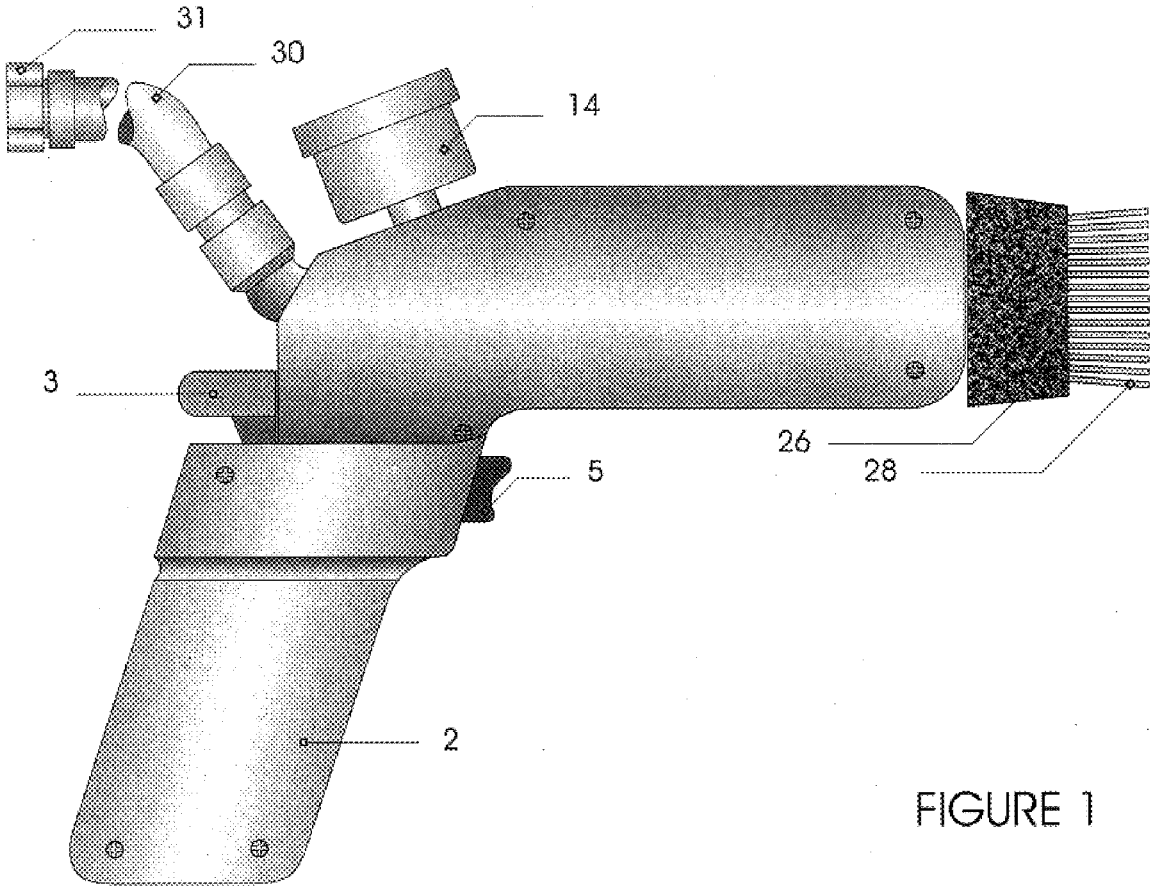
FIG. 1 is a side view of the kitchen utensil cleaning tool.
Figure 2:
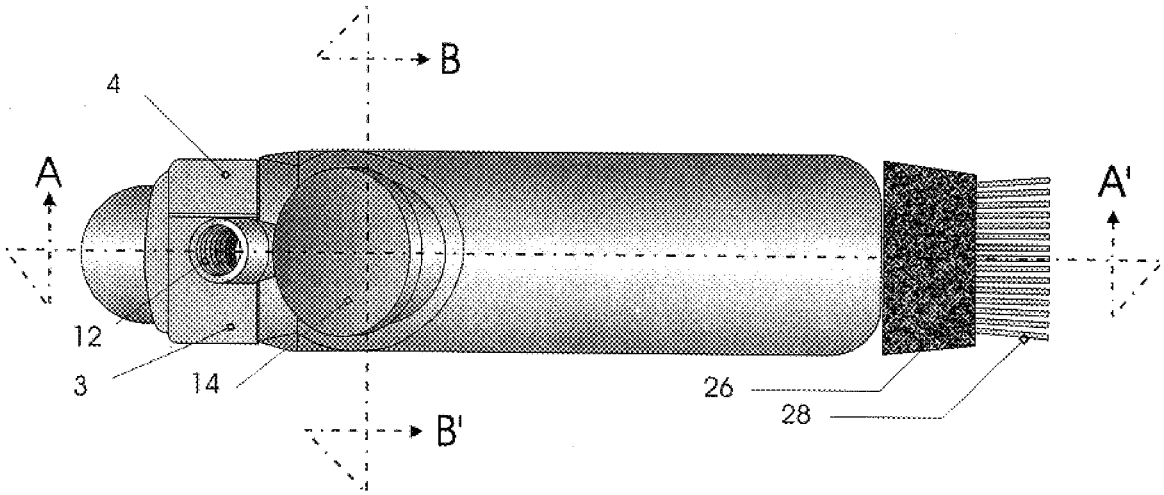
FIG. 2 is a top plan view thereof.
Figure 3:
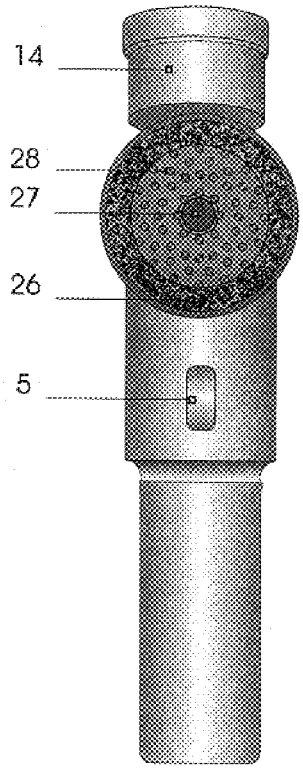
FIG. 3 is a front side view thereof.
Figure 4:
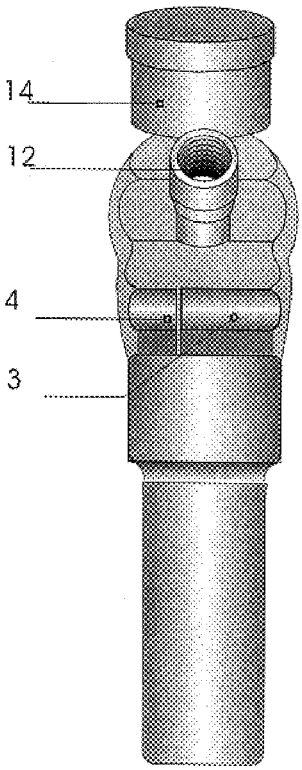
FIG. 4 is a back side view.

Following is a list of the components of the cleaning tool of the invention:

(1) Left shell of the equipment
(2) Right shell of the equipment
(3) Water valve button

(4) Detergent valve button
(5) Motor control trigger
(6) Battery (interchangeable or rechargeable)
(7) Power switch
(8) Water valve
(9) Detergent valve
(10) Water valve activating mechanism
(11) Detergent valve activating mechanism
(12) Water inlet pipe connection
(13) Fixed duct
(14) Detergent deposit
(15) Detergent injector
(16) Detergent duct
(17) Main Connections Receiving element (MCRE)
(18) Graphite seal in the coupling of the MCRE in the hollow shaft of the motor
(19) Sleeve-plug for coupling of the MCRE with the hollow shaft of the motor
(20) Hollow shaft of the motor
(21) Direct Current electric motor
(22) Shell joints
(23) Water detent
(24) Motor flywheel
(25) Interchangeable cleaning head
(26) Wash fiber
(27) Water or water-detergent outlet
(28) Washing brush
(29) Shell reinforcement
(30) Water hose
(31) Pipe or hose connection to the water network.

Figure 6:
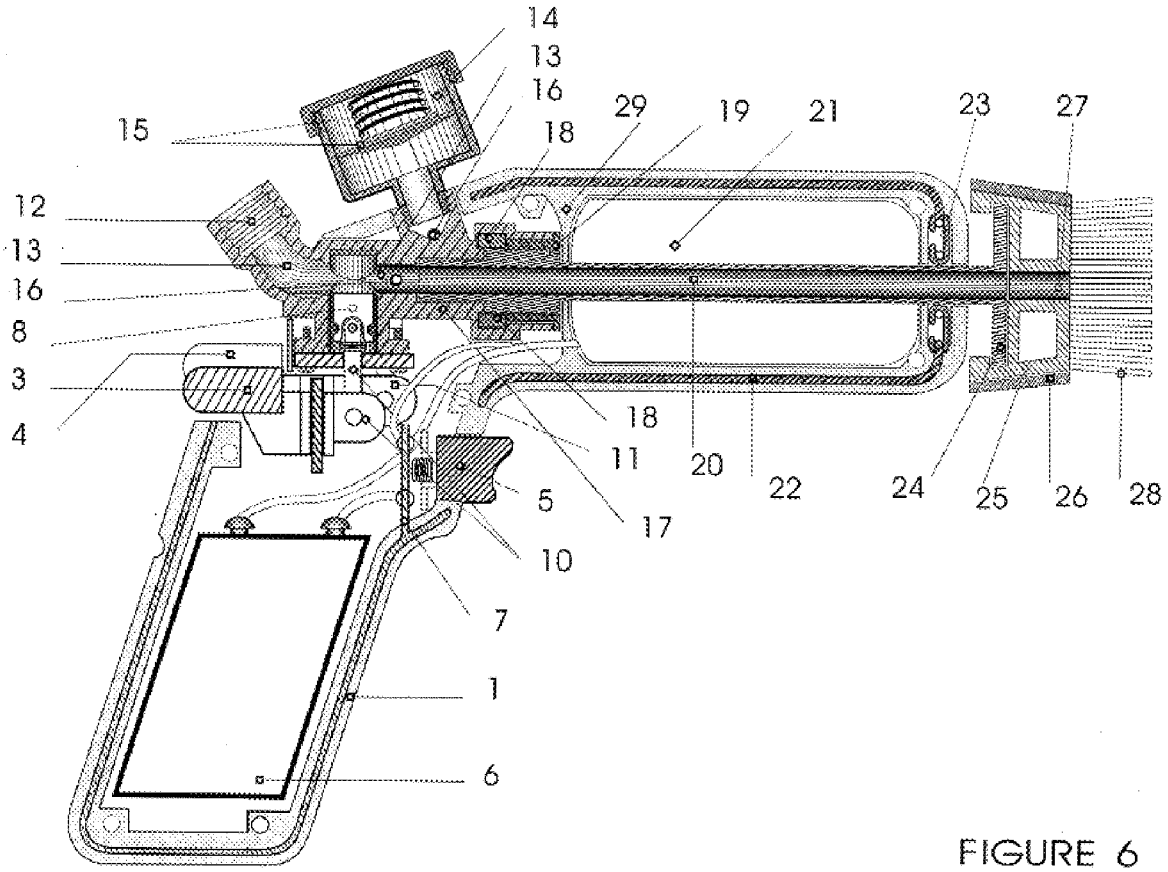
FIG. 6 is a longitudinal cross sectional view. In this view the main components of the equipment can be seen.
Figure 7:
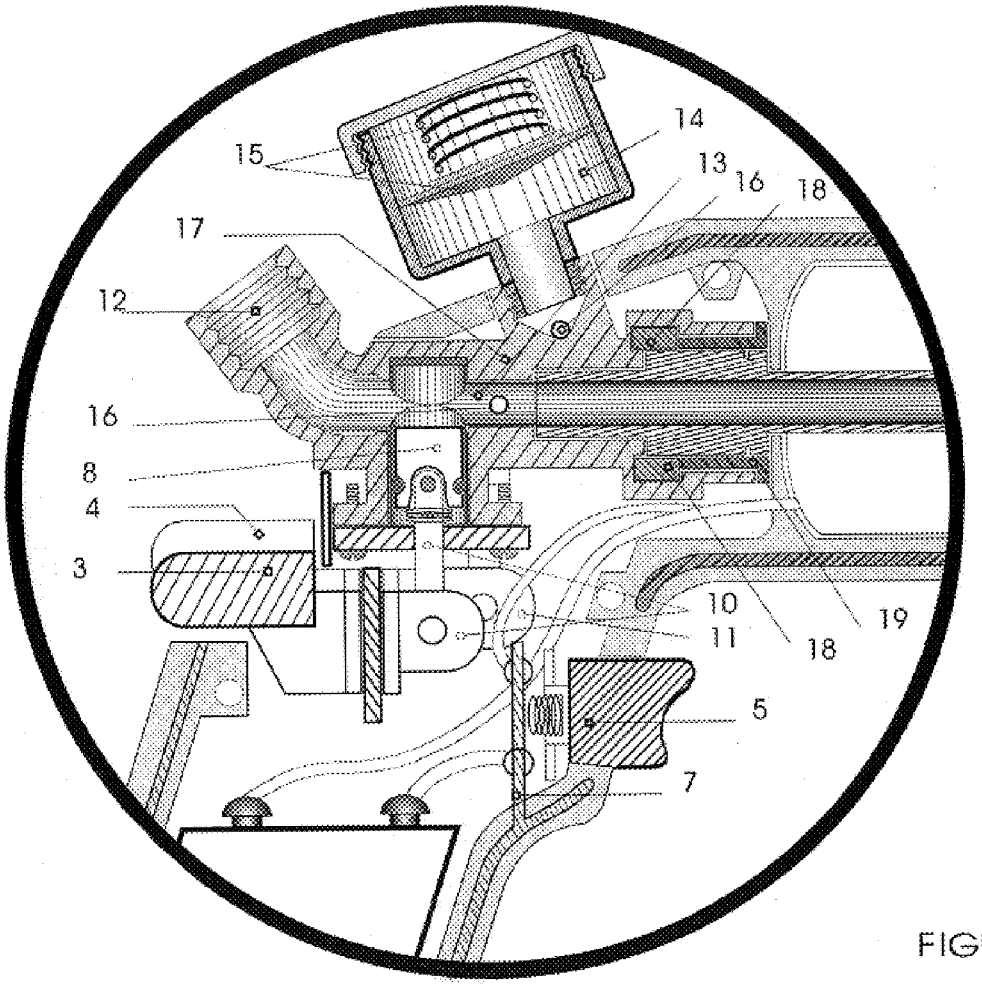
FIG. 7 is an enlarged partial longitudinal sectional view showing the main components.
Figure 8:
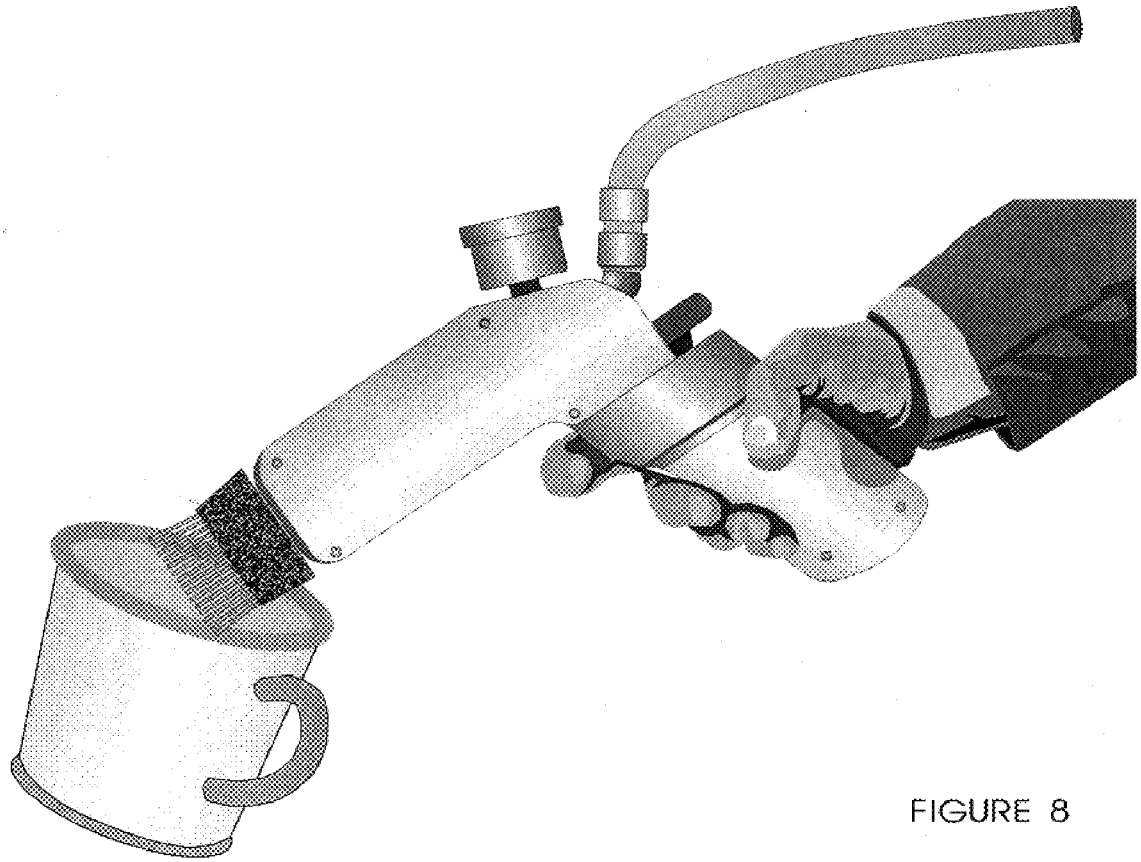
FIG. 8 is a view of the kitchen utensil cleaning tool in use.

The kitchen utensil cleaning tool of the invention combines the use of water, detergent and a revolving cleaning head to clean kitchen utensils. Water is taken from the supply pipe line The Device Includes Three Systems 1.-WATER SYSTEM. As described in FIGS. 6 and 7, water is provided from the hose (30), water enters the equipment by the connection (12), regulated by the button (3), the mechanism (10) and the valve (8), continues through the fixed duct (13) being able to mix with detergent at the "T" intersection of both ducts (16) this mixture continues through the hollow shaft (20) and through the center of the cleaning head (25) to reach the exterior, finally through the exit (27). An advantage is that the motor (21) can be cooled using by the cold water.

To impede the passage of liquid mixture from the ducts to the inside of the equipment, a seal (18) and a sleeve plug (19) are incorporated. These pieces receive the motor hollow shaft (20).

To prevent that the water retained by the kitchen utensil reaches inside the equipment, a detent (23) and a joint (22) are incorporated between the shells (1) and (2).

Figure 5:
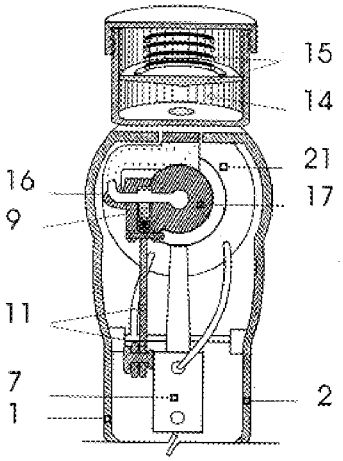
FIG. 5 is a transversal cross sectional view.

2.-DETERGENT SYSTEM. According to FIG. 5, liquid detergent is stored in the deposit or chamber (14) isolated from the exterior by a lid. The detergent is injected from the deposit by the action of the integrated injector (15). This injector exercises pressure permanently, on the liquid detergent by occlusion, by means of a spring and a diaphragm. The regulation of the detergent volume is by means of a button (4), the mechanism (11) and the valve (9). The detergent comes out of the T formed by the ducts (13) and (16).

3.-POWER SYSTEM. According to FIG. 6, acting on the trigger (5) closes the switch (7) that in turn activates electric motor (21) causing the head to rotate. This head (25) provides liquid detergent to clean the walls of the kitchen utensils by the fiber (26), and the bottom and edges of the kitchen utensils by the brush (28), depending on the object to be washed.

In addition, the three systems are integrated by means of the Main Connections Receiving Element (MCRE) (17), included in a preferred embodiment.:

A hose connection (12), a water valve (8), a valve to regulate the entrance of detergent (9), a fixed duct (13), a detergent duct (16), a seal (18) and a sleeve plug (19) to couple the hollow shaft of the motor (21). The MCRE receives the detergent deposit (14) that in turns includes the injector (15).

An interchangeable head is provided (25) that in turn includes wash fiber (26), water outlet (27) and washing brush (28). Optionally, cleaning heads can be exchanged by another for specific purposes. For the above mentioned, as well as for the change due to wear, the heads have snap coupling latches integrated in its block mounted on a flywheel (24).

Working Examples or Preferred Embodiments of the Invention

Working Example 1

In a preferred embodiment of the present invention the MCRE (17) is made of cast bronze, based on a prototype with post-machining of the valve ducts and the motor hollow shaft guide. Also, post-threading the water and detergent connection hose.

The valve chokes are also made of bronze with a rubber "O Ring" seal.

The detergent duct and the sleeve plug, are made of copper or bronze tubing and are soldered to the main body of the MCRE.

The hollow shaft and the motor flywheel are a single piece of steel.

Power is supplied by the DC motor with a power rating between 120 and 140 Watts and supplied with 9 volts by a rechargeable or disposable battery housed in a chamber in a depending hand grip of the shells.

Shells, buttons, valves mechanisms, trigger, detergent deposit, injector diaphragm, cleaning head and the brush can be made from moulded plastic.

The seal can be manufactured from graphite. The detent can be made of plastic with an inner metal spring ring.

The fiber 26 is made of synthetic plastic. The two shells carry a soft plastic joint which is sealed by pressure applied by bolts and nuts.

Working Example 2

The utensils washer is connected to the water supply pipe in the kitchen, and manually moved to the object to be washed. Water and water mixed with detergent is applied to the object to be cleaned. The water is regulated by pressure on the button (3), which controls mechanism (10) and the valve (8), to supply the water to the fixed duct (13). Detergent comes from the deposit (14) via the duct (16), due to the pressure of the injector (15). The control is obtained with the button (4), the mechanism (11) and the valve (9). Water and detergent are mixed in the "T" formed by the ducts (13) and (16). The blend of water with detergent continues through the hollow shaft (20) reaching the exterior at the outlet (27). Power is provided to the motor (21) with the trigger (5) that actuates the switch (7) and it provides energy from the battery (6) that makes the head rotate (25). The head, when combined with the previously mixed solution cleans the kitchen utensils by rubbing. Finally rinsing is accomplished with water only.

It should be pointed out that as of this date, the best known method by the applicant to carry out the present invention, is that evident from the present description of the invention.

What is claimed is:

1. A cleaning device for kitchenware comprising a main connection receiving element including an integral body having a hose connection for supply of inlet water into said body, a reservoir for detergent, and a duct connected to said hose connection and to said reservoir to receive water and detergent therefrom respectively, a water control valve means for controlling supply of water from the hose connection to said duct, detergent control valve means for controlling supply of detergent from said detergent reservoir to said duct, a hollow shaft rotatably connected to said body and in communication with said duct to receive water and detergent from said duct, said hollow shaft having an open end spaced from said body for discharge of water and detergent from said hollow shaft, a sleeve plug on said shaft for rotatably connecting said hollow shaft to said body, said sleeve plug including seal means for providing a seal connection between said body and said shaft and an electric motor for driving said hollow shaft in rotation.

2. A cleaning device for kitchenware as claimed in claim 1, comprising a cleaning head on said hollow shaft at said open end thereof to rotate with said shaft and receive water and detergent conveyed through said shaft.

3. A cleaning device for kitchenware as claimed in claim 2, wherein said cleaning head includes a brush and an annular fiber element adjacent to said brush.

4. A cleaning device for kitchenware as claimed in claim 3, wherein said cleaning head is detachably connected to said shaft.

5. A cleaning device for kitchenware as claimed in claim 3, comprising a shell including left and right shell elements surrounding said main connection receiving element, said shell having an end with a water detent, said shaft passing through said water detent and supporting said cleaning head outside said shell.

6. A cleaning device for kitchenware as claimed in claim 5, wherein said shell includes a depending hand grip portion having a hollow space to receive a battery for driving said motor which is contained in said shell and connected to said hollow shaft.

7. A cleaning device for kitchenware as claimed in claim 6, wherein said water control valve means and said detergent control valve means respectively comprise manually engageable push buttons.

8. A cleaning device for kitchenware as claimed in claim 7, wherein said manually engageable push buttons of said water control valve means and said detergent control valve means are disposed adjacent to one another at a rear, top portion of said hand grip portion.

9. A cleaning device for kitchenware as claimed in claim 8, comprising a trigger at a front portion of said hand grip portion to control connection of said battery to said motor.

10. A cleaning device for kitchenware as claimed in claim 9, wherein the arrangement of the trigger and said buttons enables the cleaning device to be held in one hand and permits the buttons and trigger to be operated by the fingers of said one hand.

11. A cleaning device for kitchenware as claimed in claim 5, comprising seal means between said left and right shell elements.

12. A cleaning device for kitchenware as claimed in claim 1, wherein said hose connection has a water duct which connects to said duct in said body and said reservoir is connected to a detergent duct which connects to said duct in said body to form a T-connection between said duct in the body and said water and detergent ducts.

13. A cleaning device for kitchenware as claimed in claim 1, wherein said reservoir for the detergent includes a lid having a diaphragm to close off said reservoir and a spring acting on said diaphragm.

* * * * *